US006009294A

United States Patent [19]

Liu et al.

[11] Patent Number: 6,009,294

[45] Date of Patent: Dec. 28, 1999

[54] ADDRESSABLE TONER APPLICATOR AND METHOD AND APPARATUS FOR ENHANCING CUSTOM COLOR CHARACTERISTICS IN A CONTACT ELECTROSTATIC PRINTING APPARATUS

[75] Inventors: Chu-heng Liu, Penfield; Weizhong Zhao, Webster, both of N.Y.

[73] Assignee: Xerox Corporation, Stamford, Conn.

[21] Appl. No.: 09/232,642

[22] Filed: Jan. 19, 1999

[51] Int. Cl.[6] ..... G03G 15/01; G03G 15/10

[52] U.S. Cl. ..... 399/237; 347/55; 347/131; 399/57; 399/233; 430/117

[58] Field of Search ..... 399/57, 223, 233, 399/237, 239, 240, 241, 242, 243, 244; 347/55, 140, 131, 115, 158; 430/117

[56] References Cited

U.S. PATENT DOCUMENTS 4,267,556 5/1981 Fotland et al. ..... 347/127
4,885,220 12/1989 Kuhman et al. ..... 430/31
5,148,222 9/1992 Lior et al. ..... 399/233
5,596,396 1/1997 Landa et al. ..... 399/237
5,619,313 4/1997 Domoto et al. ..... 399/233
5,781,828 7/1998 Caruthers, Jr. et al. ..... 399/57
5,801,838 9/1998 Larson ..... 347/131 X
5,805,185 9/1998 Kondo ..... 347/55
5,815,774 9/1998 Funayama et al. ..... 347/55 X

*Primary Examiner*—Sandra Brase
*Assistant Examiner*—Sophia S. Chen
*Attorney, Agent, or Firm*—Oliff & Berridge, PLC

[57] ABSTRACT

A contact electrostatic printing (CEP) apparatus and method provide custom color capabilities. Custom colors can be provided by combining two or more toner layers of different color. Correction of custom color toner patches can also be performed by combining toner layers. Controllable toner applicators apply toner patches in any desired size, shape or density on a support.

25 Claims, 8 Drawing Sheets

ADDRESSABLE TONER APPLICATOR AND METHOD AND APPARATUS FOR ENHANCING CUSTOM COLOR CHARACTERISTICS IN A CONTACT ELECTROSTATIC PRINTING APPARATUS

BACKGROUND OF THE INVENTION

1. Field of Invention

This invention relates generally to liquid developing material-based electrostatic latent image development, wherein a layer of liquid developing material is brought into contact with a latent image-bearing surface in the vicinity of an electric field for causing selective image-wise separation of the liquid developing material layer to produce a desired output image corresponding to the latent image. In particular, the invention relates to methods and apparatus for enhancing the capabilities of such printing systems to provide on-demand custom colors. The invention also relates to a selectively addressable toner applicator that can apply toner patches of varying size, shape, density and location on a toner support.

2. Description of Related Art

Generally, processes for electrostatographic copying and printing are initiated by selectively charging and/or discharging a charge receptive imaging member in accordance with an original input document or an imaging signal in order to generate an electrostatic latent image on the imaging member. The electrostatic latent image is subsequently developed into a visible image by a process in which charged toner particles are brought into the vicinity of the latent image and caused to migrate to image areas thereof. Typically, the developing material may include carrier granules having marking or toner particles adhering triboelectrically thereto, wherein the toner particles are electrostatically drawn away from the carrier granules and attracted to the latent image areas to create a powder toner image on the imaging member.

Alternatively, the developing material may include a liquid developing material comprising a carrier liquid having charged pigmented marking particles (or so-called toner solids) immersed therein. The charge on the marking particles is created by a soluble ionic surfactant, or so-called charge director material, dispersed and/or dissolved in the liquid carrier/marking particle composition to create an electrochemical reaction, which results in the exchange of ionic species between the marking particles and micelles formed by the charge director. In the case of traditional liquid developing material-based development processes, the liquid developing material is generally applied to the surface of the latent image bearing member, with the charged marking particles being caused to electrophoretically precipitate from the liquid developing material dispersion and be deposited upon the image areas of the latent image to form a developed liquid image.

Regardless of the type of developing material employed, the toner or marking particles of the developing material are typically uniformly charged and attracted to the latent image via electrostatic fields for forming a visible developed image corresponding to the latent image on the imaging member. The developed image is subsequently transferred, either directly or indirectly, from the imaging member to a copy substrate, such as paper or the like, to produce a "hard copy" output document. In a final step, the imaging member is cleaned to remove any residual developing material and/or charge therefrom in preparation for a subsequent image forming cycle.

The above-described electrostatographic process is well known and has been implemented in various forms to facilitate, for example, so-called light lens copying of an original document, as well as for printing of electronically generated or digitally stored images where the electrostatic latent image is formed via a modulated laser beam. Analogous processes also exist in other electrostatic printing applications such as, for example, ionographic printing and reproduction where charge is deposited in an image-wise configuration on a dielectric charge retentive surface (see, for example, U.S. Pat. Nos. 4,267,556 and 4,885,220, among numerous other patents and publications), as well as other electrostatic printing systems wherein a charge carrying medium is adapted to bear an electrostatic latent image. It will be understood that the instant invention applies to all various types of electrostatic printing systems and is not intended to be limited by the manner in which the image is formed on the imaging member or the nature of the latent image bearing member itself.

As described above, the typical electrostatographic printing process includes a development step whereby developing material including toner or marking particles is physically transported into the vicinity of a latent image bearing imaging member, with the toner or marking particles being caused to migrate via electrical attraction of toner or marking particles to the image areas of the latent image so as to selectively adhere to the imaging member in an image-wise configuration. The development process is most effectively accomplished when the particles carry electrical charges opposite in polarity to the latent image charges, with the amount of toner or marking particles attracted to the latent image being proportional to the electrical field associated with the image areas. Some electrostatic imaging systems operate in a manner wherein the latent image includes charged image areas for attracting developer material (so-called charged area development (CAD), or "write white" systems), while other printing processes operate in a manner such that discharged areas attract developing material (so-called discharged area development (DAD), or "write black" systems).

Numerous and various alternative methods of developing a latent image have been described in the art of electrophotographic printing and copying systems. Of particular interest with respect to the present invention is the concept of forming on a surface a thin layer of liquid developing material having a high concentration of charged marking particles, with the layer being acted upon by image-wise forces and separated into image and background portions. For the purposes of the present description, the concept for latent image development via direct surface-to-surface transfer of a toner layer via image-wise forces will be identified generally as Contact Electrostatic Printing (CEP). As one variant of CEP, a thin layer of liquid developer is brought into contact with an electrostatic latent image on another surface, wherein development of the latent image occurs upon separation of the first and second surfaces, as a function of the electric field strength generated by the latent image. In this process, toner particle migration or electrophoresis is replaced by direct surface-to-surface transfer of a toner layer induced by image-wise fields. Some of the hallmarks of a CEP system include:

(a) a liquid toner medium that has a relatively high solid content (approximately 10–50%) in a form of a thin layer (approximately 5–30 microns); and (b) limited relative movement between toner particles during and after latent image development, i.e. the relatively high solid content of the toner prevents toner particles from moving relative to each other, unlike that in the traditional liquid developing mediums, and the liquid carrier in the toner serves to bind the toner particles together as a single mass, unlike the individual toner particles in powder developing systems.

Patents which may describe certain general aspects of CEP, as well as specific apparatus therefor, may be found in U.S. Pat. Nos. 5,436,706 and 5,596,396, issued to Landa et al., U.S. Pat. No. 5,619,313, issued to Domoto et al., as well as other patents cited therein.

On-demand custom color capability of electrostatographic printing systems, including CEP, may vary significantly due to numerous conditions affecting image development, among various factors including but certainly not limited to, the methods and apparatus used to mix the primary colors to achieve the desired custom color and the process controls implemented on the color mixing and development subsystems to maintain the color accuracy and stability. In general, a number of primary color developers are mixed in a reservoir with certain proportions according to the customer selection and then the developer mixture is applied to the latent image for development. Example patents which may describe certain general aspects for achieving customer selectable colors, as well as specific apparatus therefor, may be U.S. Pat. No. 5,781,828, issued to Caruthers, Jr. et al., as well as other patents cited therein.

SUMMARY OF THE INVENTION

Prior art systems do not have the capability of generating custom colors when using two or more toners while on-demand custom color systems do not provide capabilities to generate custom color toner layers with the desired properties suitable for CEP systems.

The invention provides an image forming system that forms a custom color image by at least partially overlapping at least two toner layers having a relatively high solid concentration on an image support. The portion where the toner layers overlap has a custom color that results from the combination of the at least two toner layers. A charge pattern generator generates an electrostatic charge pattern that operates on toner to create a toner image on the image support.

In one aspect of the invention, two or more toner layers are deposited on the image support to form a custom color toner layer before the custom color toner layer is acted on by at least one electrostatic charge pattern to form a custom color toner image.

In one aspect of the invention, each toner layer is deposited on the image support before being acted on by an electrostatic charge pattern.

In one aspect of the invention, two or more toner layers that each define a toner image are combined on the image support to form a custom color toner image.

In one aspect of the invention, an electrostatic charge pattern is formed on the image support before the toner layers are applied to the image support. Thus, the electrostatic charge pattern causes a custom color toner image to be formed on the image support as the toner is applied to the image support.

In one aspect of the invention, the charge pattern generator generates the electrostatic charge pattern on a support before at least one toner layer is applied to the support.

In one aspect of the invention, the charge pattern generator generates the electrostatic charge pattern on a member separate from the image support, and the electrostatic charge pattern is used to act on a toner layer deposited on the image support.

In one aspect of the invention, at least one toner applicator is controllable to selectively deposit toner patches of varying size, shape and location on a support.

In one aspect of the invention, toner is applied to an intermediate support that transfers toner to the image support.

In one aspect of the invention, the toner applicators apply toner directly to the image support.

In one aspect of the invention, a custom color toner layer can be adjusted in color, density or other features by applying a color toner to a portion of the custom color toner layer.

In one aspect of the invention, two or more different color toners are deposited to generate a custom color toner layer on a support.

The invention also provides a method for performing a contact electrostatic printing process. According to the method, a plurality of toner layers are deposited on a support, each toner layer initially having a solid concentration of 10–50%. At least two toner layers are at least partially overlapping to form a custom color in the overlapping portion. An electrostatic latent image is formed that acts on at least one of the toner layers.

In one aspect of the invention, two or more toner layers are deposited on an image support to form a custom color toner layer before the custom color toner layer is acted on by at least one electrostatic charge pattern.

In one aspect of the invention, each toner layer is deposited on the image support before being acted on by an electrostatic charge pattern.

In one aspect of the invention, two or more toner layers that each define a toner image are combined on the image support to form a custom color toner image.

In one aspect of the invention, an electrostatic charge pattern is formed on the image support before the toner layers are applied to the image support. Thus, the electrostatic charge pattern causes a custom color toner image to be formed on the image support as the toner is applied to the image support.

In one aspect of the invention, the charge pattern generator generates the electrostatic charge pattern on a support before at least one toner layer is applied to the support.

In one aspect of the invention, the charge pattern generator generates the electrostatic charge pattern on a member separate from the image support, and the electrostatic charge pattern is used to act on a toner layer deposited on the image support.

In one aspect of the invention, toner patches of varying size, shape and location are deposited on a support.

In one aspect of the invention, toner layers are applied directly to the image support.

In one aspect of the invention, a custom color toner layer is adjusted in color, density or other features by applying a color toner to a portion of the custom color toner layer.

The invention also provides an addressable toner applicator that is controllable to form toner patches that vary in size, shape, density and/or location on a support.

BRIEF DESCRIPTION OF THE DRAWINGS

The invention will be described in relation to the following drawings in which reference numerals refer to like elements, and wherein.

DETAILED DESCRIPTION OF PREFERRED EMBODIMENTS

Figure 1:
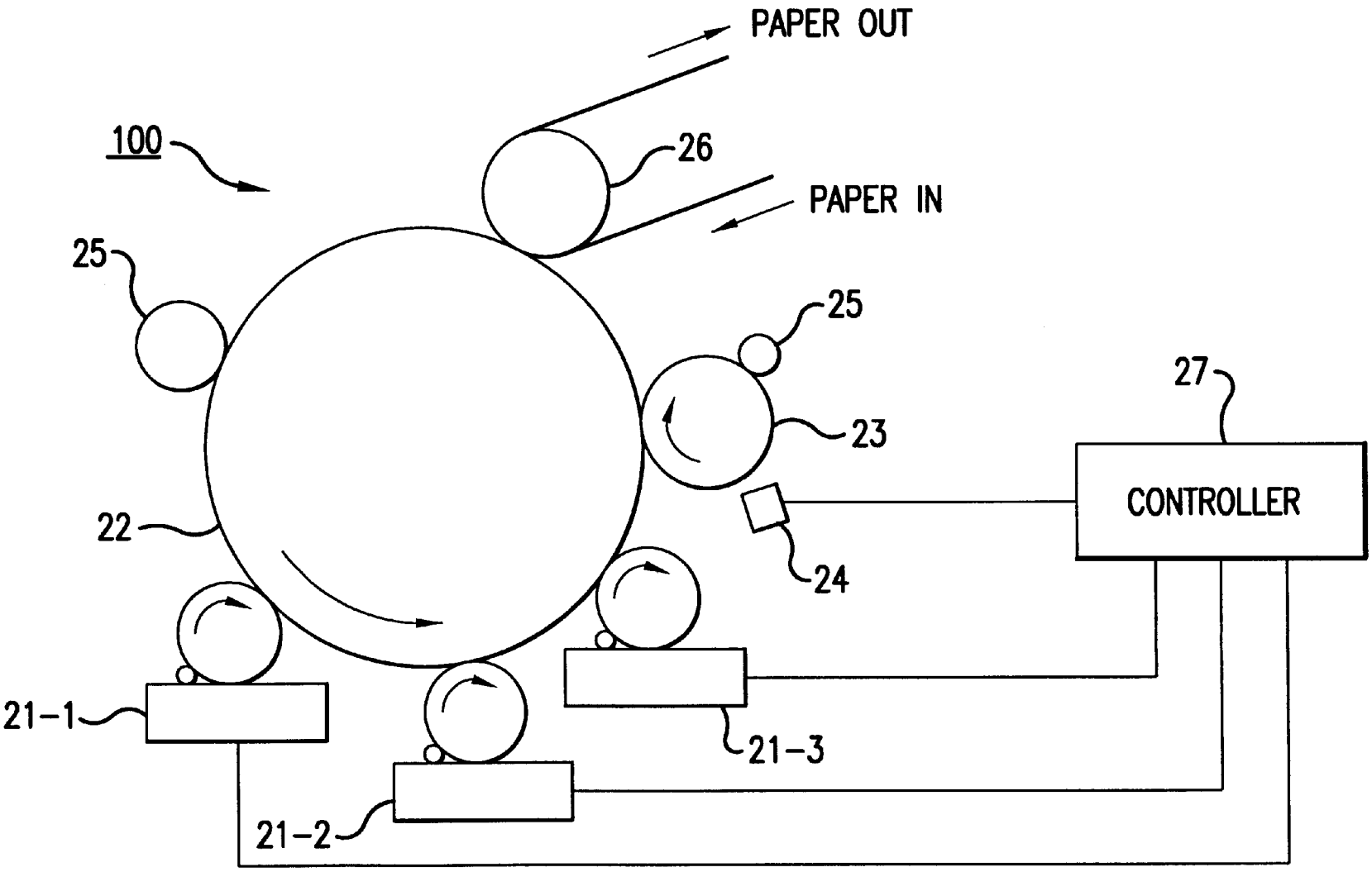
FIG. 1 is a schematic diagram of a CEP apparatus in accordance with the invention.

Several of the elements of a CEP apparatus are similar to, if not the same as, corresponding elements in the conventional liquid and/or solid toner electrostatic printing systems. Such elements include photosensitive drums, cleaning apparatus, charging devices and associated control systems. Accordingly, since these elements are well known, only differences between elements as used in the CEP apparatus of the invention and the corresponding elements of the conventional systems are described below.

As used in this application, the term "toner layer" can refer to a continuous or discontinuous layer of one kind of toner, e.g., a toner having a given color, that either forms a toner image, e.g. has been acted on by an electrostatic latent image to have the appearance of a desired image, or that has not been acted on by an electrostatic latent image. A toner layer can be acted on by an electrostatic latent image either by being first deposited on a support and coming into contact with a separate member having the electrostatic latent image formed on it, or by being deposited on a support carrying the electrostatic latent image. A custom color toner layer refers to any combination of two or more toner layers in which at least a portion of at least two toner layers overlap to form a custom color. Thus, the entire custom color toner layer need not exhibit or have the appearance of a single custom color. Instead, the custom color toner layer could exhibit two or more different colors, of which at least one color is a custom color. A toner image has the appearance of a desired image and at least one toner layer in the toner image has been acted on by an electrostatic latent image.

The inventors have discovered that one or more CEP toner layers can be applied on top of another CEP toner layer. The resulting overlapping toner layers have a final color and density that is a combination of the constituent toner layer colors and densities. For example, a yellow CEP toner layer can be formed on top of a blue CEP toner layer to create a composite toner layer having a green color, or the appearance of green. Accordingly, a CEP apparatus in accordance with the invention can generate custom colors by combining two or more different toner layers.

Conventional liquid printing systems, such as liquid immersion development (LID) systems, can generate custom colors by combining two or more primary color toners before depositing the toners and then depositing the combined toner. However, due to the differences in physical and chemical properties of the toners of different colors and other factors, a sophisticated feedback scheme must be used to obtain accurate color reproduction and color stability.

In contrast to LID systems, the toners in a CEP system need not be pre-mixed to form a custom color because in CEP systems toner layers can be combined to form the custom color toner layer. No sophisticated control mechanism is needed to control the custom colors formed by combining toner layers because the toners that make up the custom color layer are completely consumed in a CEP development system. Furthermore, the differential mobility of the toners when two or more deposited toner layers having a relatively high solid content, e.g., 15–50%, are combined is very small. That is, the toner in each of the layers does not move relative to each other to any great degree. Therefore, CEP toner layers can be combined to reliably generate an accurate and stable custom color that does not require a sophisticated feedback scheme to correct for color variations found in the LID systems and other similar systems. In addition, because the toners need not be pre-mixed, less toner is wasted when generating a custom color.

FIG. 1 is a schematic diagram of a first embodiment of a printing apparatus in accordance with the invention. Three toner applicators 21-1, 21-2 and 21-3 each apply a layer of toner on an outer surface of an image roll 22. Preferably, the toner applicators 21 are controllable to deposit patches of varying size, shape and density on the image roll 22, as discussed more fully below. Although the CEP apparatus 100 shown in FIG. 1 includes three toner applicators 21, fewer or more toner applicators 21 can be used. In addition, the toner applicators 21 need not be controllable to deposit discrete patches of toner on the image roll 22. Rather, the toner applicators 21 could deposit continuous layers of toner of a desired density and/or thickness.

Because multiple toner layers can be combined in a CEP process to create custom colors, the toner applicators 21-1, 21-2 and 21-3 preferably apply different color toners to the image roll 22. For example, toner applicator 21-1 can apply a blue toner, toner applicator 21-2 can apply a red toner, and toner applicator 21-3 can apply a yellow toner. As is understood by those of ordinary skill in the art, these three primary colors blue, red and yellow, can be combined to create a variety of colors having a variety of densities.

In order to achieve good toner layer overlapping, a second layer of toner with different color is added to the image roll 22 with minimal disturbance to the previous toner layer(s). The toners of different colors are preferably charged to the same polarity to enable electrostatic transfer of toner layers. The toner applicators 21-1, 21-2 and 21-3 are preferably biasable such that the image roll 22 is more attractive to the toners at the interfaces where the toner layers are applied to the image roll 22.

The toner applicators 21-1, 21-2 and 21-3 preferably apply toner to the image roll 22 using a supply limited transfer process. That is, a toner layer, or cake, is formed by the toner applicator 21 and the toner layer is transferred in a block to the image roll 22 during creation of a toner layer on the image roll 22, i.e. all of the toner in the toner layer, or a predefined portion, or slice, of the entire layer, is transferred to the image roll 22.

As the image roll 22 rotates as shown in FIG. 1, the toner layers formed on the outer surface of the image roll 22 by the toner applicators 21-1, 21-2 and 21-3 are acted upon by an electrostatic charge pattern, i.e., a latent image, formed on a photoreceptor 23. The electrostatic charge pattern is generated on the photoreceptor 23 by an electrostatic charge pattern generator 24 in a known manner. Preferably, the electrostatic charge pattern generator 24 includes a charging device, such as a corotron, scorotron or roller that charges a photosensitive outer surface of the photoreceptor 23 to a desired voltage level. The electrostatic charge pattern generator 24 also preferably includes a light source, such as a laser, that illuminates selected portions of the charged surface of the photoreceptor 23 to thereby discharge the selected portions. The resulting charge pattern corresponds to or otherwise represents a desired image, such as an image scanned from a paper document or created using another imaging or image generating device, such as a camera or computer paint or draw application.

Once the latent image is formed, CEP development occurs through the contact of the latent image and the toner layer support with a toner layer sandwiched in between. As illustrated in FIG. 1, the electrostatic charge pattern on the photoreceptor 23 operates to separate the toner layer into image and background portions with the image on one surface and the background on the other. It is understood that some embodiments of CEP operate to use only a fraction of the toner layer thickness to form the developed toner image. Due the layering structure of the custom color toner patches, this will result in color differences between the custom color toner layer and the final toner image. Thus it is preferred that the CEP development operates in a supply limited mode. That is, the entire toner mass of a composite toner layer, or custom color cake, corresponding to the image area of the latent image, is developed into the image portion of the toner image. In a CEP development system where there is no fluid loss, the entire thickness of the toner layer is developed into a toner image. The supply limited development feature enables the color consistency between the toner layer and the final toner image. The supply limited development process described here is intended to include processes or systems in which a concentrated layer of toner having a layer of dilute fluid formed on one surface is used to develop an electrostatic latent image.

The electrostatic charge pattern on the photoreceptor 23 operates to selectively remove portions of the toner on the image roll 22. Other toner portions left on the image roll 22 represent a developed toner image that is preferably transferred to a final surface, such as a paper substrate, by a transfixing device 26. The transfixing device 26 transfers the toner image on the image roll 22 to the final surface using any one of known techniques, including pressure, heat and/or an electrical charge differential. Of course, the desired toner image that is transferred by the transfixing device 26 to a paper substrate, for example, could be formed on and transferred from the photoreceptor 23 rather than the image roll 22. In this case, the image roll 22 serves only as a toner layer carrier. In either case, residual toner left on the image roll 22 or the photoreceptor 23 is removed by a cleaning devices 25. The cleaning devices 25 can include a scraping blade and/or a sponge roller and/or lamp and/or other known devices for removing residual toner and any remaining electrical charge on the image roll 22 and/or the photoreceptor 23.

The toner applicators 21 and the electrostatic charge pattern generator 24 are preferably controlled by a controller 27. However, the controller 27 can control the operation of and/or receive information from other elements in the CEP apparatus 100, such as the cleaning devices 25, the transfixing device 26, the image roll 22 and/or the photoreceptor 23. In addition, the controller 27 need not control the operation of the toner applicators 21 if the toner applicators 21 are not controllable to deposit toner patches of varying size and shape and/or are not controllable to deposit toner layers of varying density and/or thickness on the image roll 22.

The controller 27 is preferably includes a general purpose computer that is programmed and has appropriate circuitry to supply the appropriate control signals to the control elements of the CEP apparatus 100. The controller 27 can also be implemented, at least in part, as a single special purpose integrated circuit (e.g., ASIC) or an array of ASICs, each having a main or central processor section for overall, system-level control, and separate sections dedicated to performing various different specific computations, functions and other processes under the control of the central processor section. The controller 27 can also be implemented using a plurality of separate dedicated programmable integrated or other electronic circuits or devices, e.g., hardwired electronic or logic circuits such as discrete element circuits or programmable logic devices. The controller 27 also preferably includes other devices, such as volatile or non-volatile memory devices, communications devices, relays, motors, mechanical linkages, and/or other circuitry or components necessary to perform the desired input/output or other functions.

Although the CEP apparatus 100 can create custom colors by combining two or more differently colored toners, the CEP apparatus 100 could be optionally equipped with a color correction device that senses the color and density of toner layers on a toner support and makes fine adjustments to the toner color and/or density by applying additional toner to the custom color toner layer. For example, the color correction device could detect that a deposited custom color toner layer is not red enough and control the CEP apparatus 100 to deposit red toner on the custom color toner layer to achieve the desired color. The color correction device preferably includes a color image sensing device, e.g. CCD imager, and associated circuitry and software modules, if necessary, to evaluate the detected color and output appropriate control signals to adjust the CEP apparatus 100 operation.

In the FIG. 1 CEP apparatus 100, there preferably is no image or toner layer conditioning between each toner application. That is, there is no device or other processing to remove fluid from a deposited toner patch before another toner patch is applied to the image roll 22 either next to or on top of the first deposited toner patch. Normally, such toner layer stabilizing/conditioning is performed to avoid any color contamination or ink poisoning problems that occur or may occur when toners mix or are near each other. Toner layer or image conditioning removes liquid from the deposited toner layers, thereby decreasing the toner particle mobility and ability of the toner layer to mix with subsequently deposited toner layers and is commonly used in liquid developing systems that use liquid developer having a relatively low solid concentration, e.g. 2–5%. However, since the toner layers in a CEP apparatus have a relatively high solid content, toner layer or image conditioning may not be necessary. However, if desired, optional toner stabilizing processes can be implemented to enhance the system stability.

Figure 2:
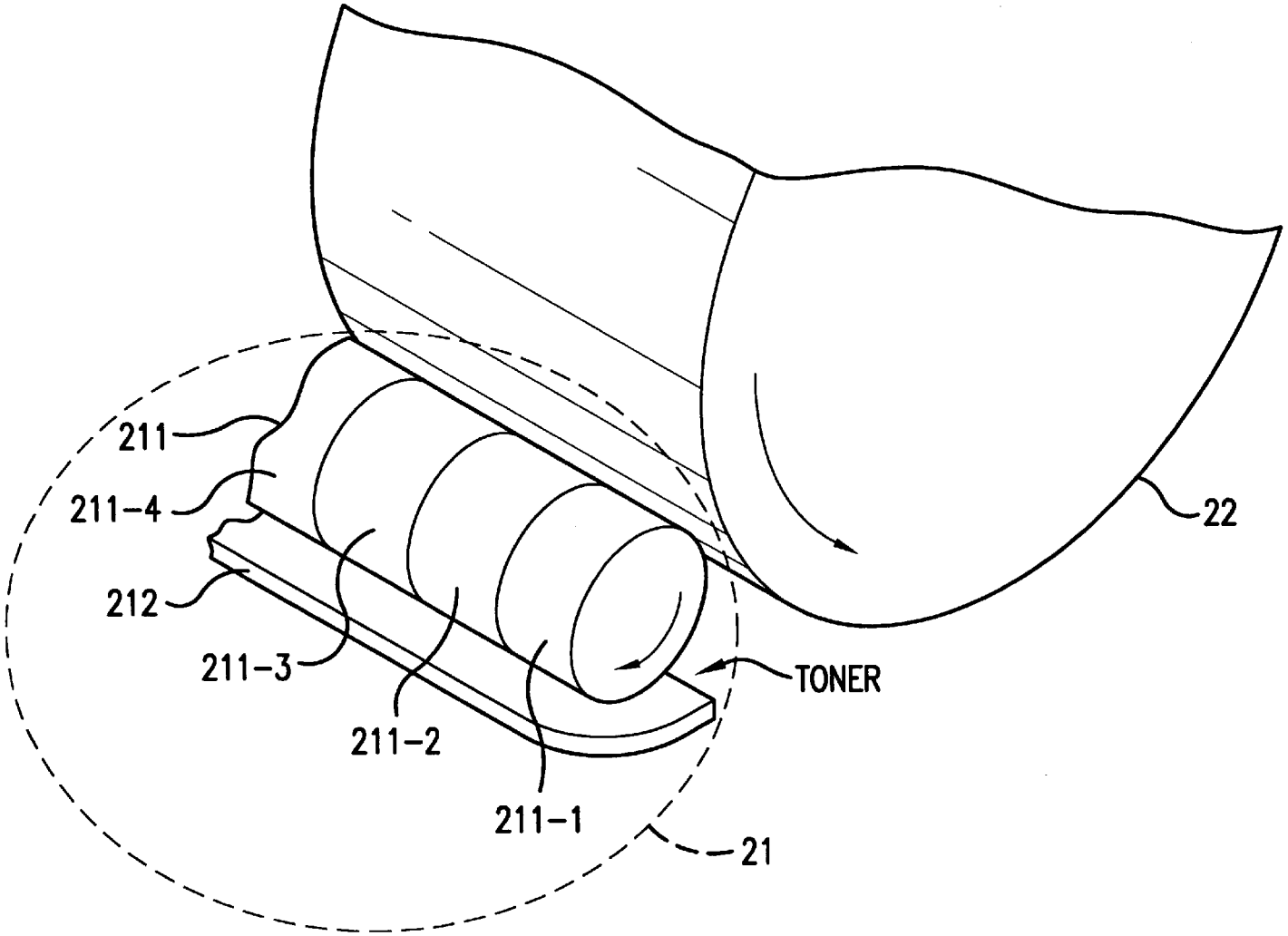
FIG. 2 is a schematic diagram of a first embodiment of an addressable toner applicator in accordance with the invention.

As discussed above, the toner applicators 21 can be controllable to deposit patches of varying size, shape, density and location on the image roll 22. FIG. 2 is a schematic diagram of a first embodiment of an addressable toner applicator 21 in accordance with the invention. The toner applicator 21 includes a rotating electrode 211 and a counter electrode 212 both made of a conductive material or having a conductive coating. The rotating electrode 211 is segmented into four or more sub-electrodes 211-1 through 211-4 that are electrically insulated from each other and individually addressable, i.e. each sub-electrode 211-1 through 211-4 can be individually charged to a desired level. Each sub-electrode 211-1 through 211-4 can be addressed by individual leads that run inside the rotating electrode 211 to each sub-electrode 211-1 through 211-4 or by contacting each sub-electrode 211-1 through 211-4 on its outer surface.

Electrostatically activated toner, i.e. charged toner, is supplied into the space between the rotating electrode 211 and the counter electrode 212. An electric bias is applied between the rotating electrode 211 and the counter electrode 212 so that the activated toner is selectively attracted to either the rotating electrode 211 or the counter electrode 212. For example, if negatively charged toner is supplied to the toner applicator 21, the rotating electrode 211 is positively charged and the counter electrode 212 is negatively charged, the toner will be attracted to and adhere to the rotating electrode 211. By reversing the bias, the toner will not be attracted to the rotating electrode 211. Therefore, since toner can be selectively deposited on the rotating electrode 211 by controlling the polarity of the bias between the rotating electrode 211 and the counter electrode 212, roughly rectangular-shaped patches of toner can be selectively deposited on the sub-electrodes 211-1 through 211-4 and/or the rotating electrode 211. The rotating electrode 211 contacts the image roll 22 so that the toner patches are deposited on the image roll 22. Of course, the rotating electrode 211 need not apply the toner only to an image roll 22. Instead, the toner could be applied to a photoreceptor or any other toner bearing or image bearing surface. The density of the toner layer that is ultimately applied to the image roll 22 is controlled by varying the magnitude of the bias between the rotating electrode 211 and the counter electrode 212.

In operation, the bias applied between the rotating electrode 211 and the counter electrode 212 is controlled, e.g. by the controller 27, so that toner is applied to the rotating electrode 211, and therefore an image support, so that toner is applied only to areas needing the specific color toner. Thus, toner need not be applied to areas of the image roll 22, photoreceptor 23, etc. that do not need it and toner is not wasted. For example, if a typical page of text organized in lines of characters is being printed, toner need only be applied to the support in thin rectangular lines rather than in one continuous layer. Likewise, if an image includes only a small blue colored portion, blue toner can be applied only to a corresponding area on the image roll 22, photoreceptor 23, etc. and not to other areas.

Further, if multiple toner applicators 21 are used, driving signals to the toner applicators 21 are synchronized so that toner patches are appropriately applied to achieve the desired colors and densities. For example, if an image contains a green rectangle, a first toner applicator 21 is first controlled to apply a rectangle of blue toner to a support, followed by a second toner applicator 21 that applies a rectangle of yellow toner over the blue toner.

Figure 3:
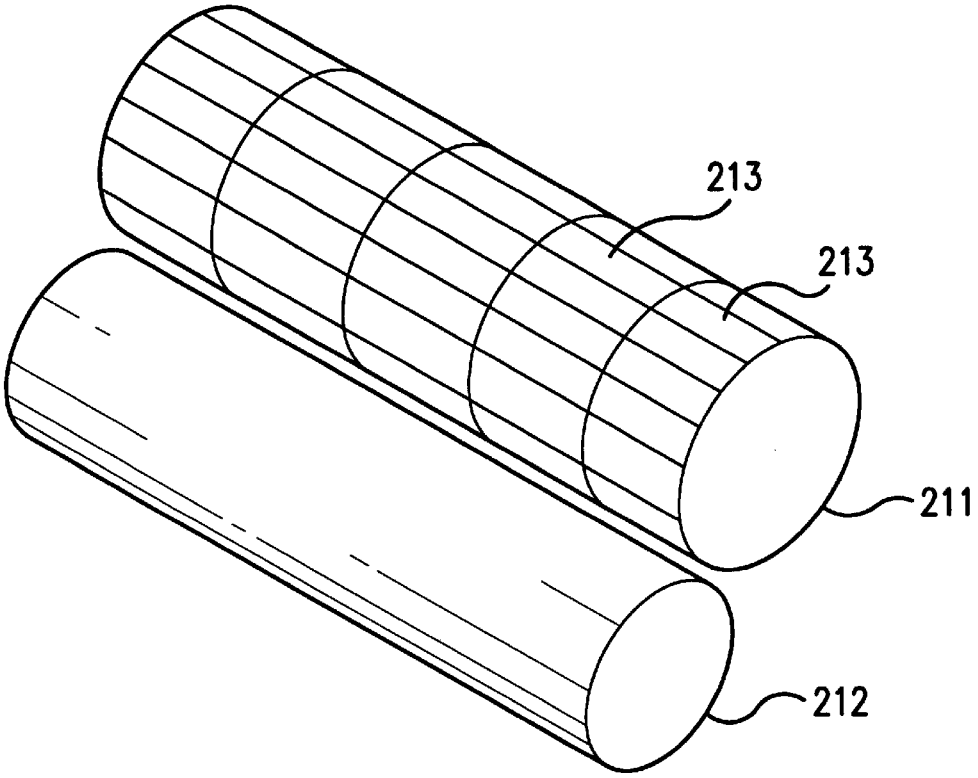
FIG. 3 is a schematic diagram of a second embodiment of an addressable toner applicator in accordance with the invention.
Figure 4:
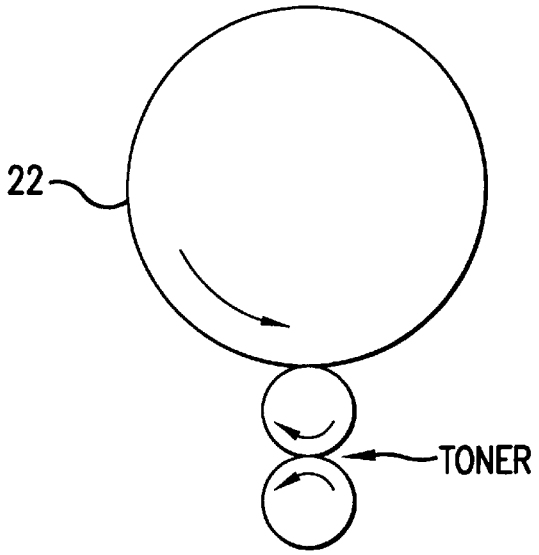
FIG. 4 is a side view of the second embodiment of an addressable toner applicator in accordance with the invention.

FIG. 3 shows a second embodiment of an addressable toner applicator in accordance with the invention. In this embodiment, the rotating electrode 211 is segmented into a plurality of individually addressable electrodes 213 that are electrically insulated from each other. Since each electrode is individually addressable, a patch of toner can be selectively formed on each electrode 213 and later deposited on a toner support, e.g. a photoreceptor 23, image roll 22, donor roll, etc. In this embodiment, the counter electrode 212 is a cylindrical roll made of a conductive material, such as aluminum, or coated with a conductive material. The counter electrode 212 can rotate or not, as desired, and replace the substantially flat or curved counter electrode 212 in the FIG. 2 embodiment. If the counter electrode 212 rotates, the counter electrode 212 preferably rotates in either of the directions shown in FIG. 4. The FIG. 3 embodiment operates similarly to the FIG. 2 embodiment. That is, a voltage bias between the electrodes 213 and the counter electrode 212 controls whether the electrostatically activated toner is attracted to the electrodes 213, and the magnitude of the bias controls the density of the toner patch formed on the electrodes 213. As in the first embodiment, a controller, such as the controller 27, provides a signal or signals to the toner applicator 21 to establish the desired voltage bias.

Figure 5:
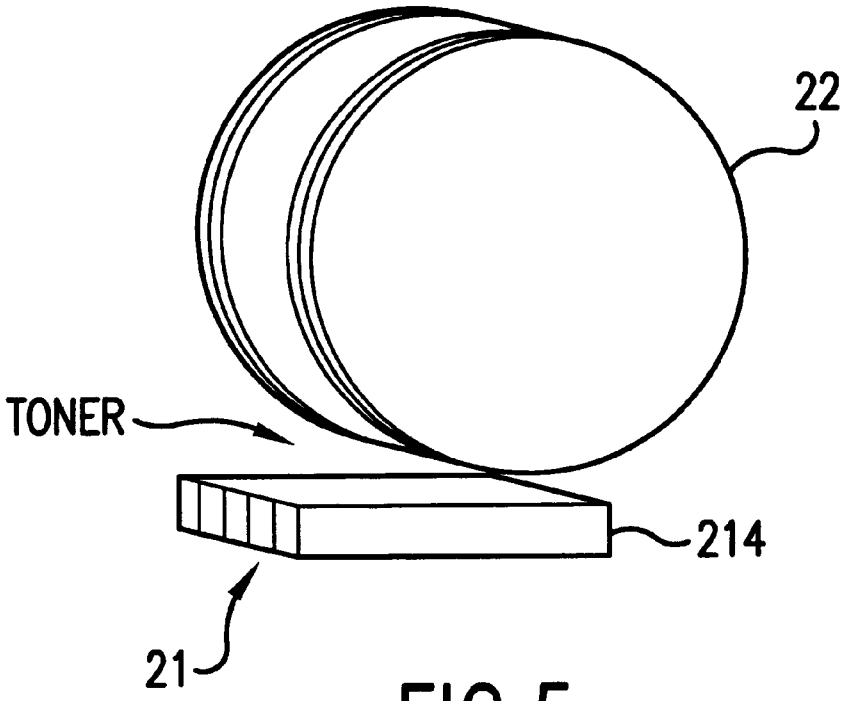
FIG. 5 is a schematic diagram of a third embodiment of an addressable toner applicator in accordance with the invention.
Figure 6:
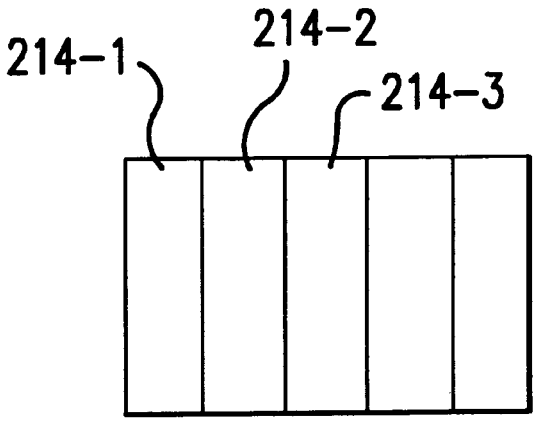
FIG. 6 is a top view of an addressable electrode in the third embodiment of the addressable toner applicator in accordance with the invention

FIG. 5 shows a third embodiment of an addressable toner applicator in accordance with the invention. In this embodiment, the toner applicator 21 has no moving parts. Instead, a substantially flat, or somewhat curved, electrode structure 214 is positioned near a toner support, such as the image roll 22 or some other toner carrier or donor roll, which acts as a counter electrode. As shown in FIG. 6, the electrode structure 214 is segmented into a plurality of individual electrodes 214-1, 214-2, 214-3, etc. that are electrically insulated from each other. The electrode structure 214 is made of a conductive material, such as aluminum, or is coated with a conductive material. Similar to the embodiments discussed above, a voltage bias between each of the electrodes 214-1, 214-2, 214-3, etc. and the toner support, in this case the image roll 22, determines whether the electrostatically activated toner is deposited on the toner support or not. The magnitude of the bias determines the density of the toner layers applied to the toner support.

The addressable toner applicators described above are not limited to use in CEP systems and can be used in other printing apparatus, especially liquid developing systems or other systems that can benefit from using an addressable toner applicator.

Figure 7:
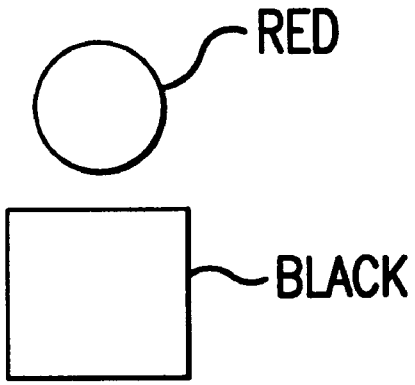
FIG. 7 is a sample image printed by a CEP apparatus.
Figure 8:
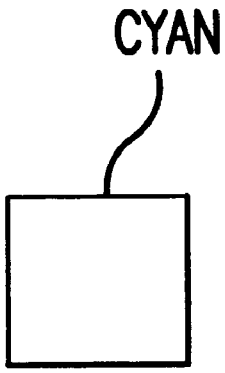
FIG. 8 is a first component toner patch for the image shown in FIG. 7.
Figure 9:
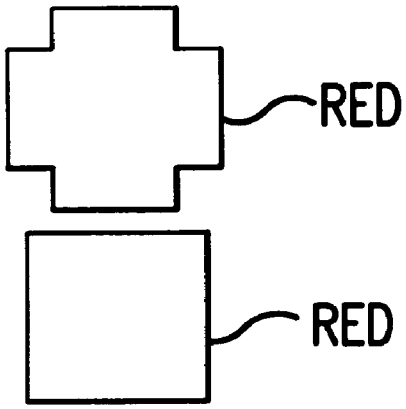
FIG. 9 is a second component toner patch for the image shown in FIG. 7.
Figure 10:
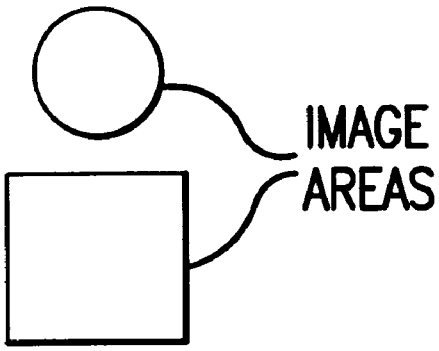
FIG. 10 is an electrostatic latent image for the image shown in FIG. 7.

FIGS. 7–10 are used to explain an advantage of some aspects of the invention. FIG. 7 shows a desired final image to be printed by the CEP apparatus 100. The FIG. 7 image includes a red circle over a black square. When the controller 27 receives image information representing an image such as that shown in FIG. 7, the controller 27 preferably decomposes the image into constituent colors consisting of the colors that can be applied by the toner applicators 21. In this example, the CEP apparatus 100 includes two toner applicators 21 that respectively apply red and cyan toner. The red circle can be printed directly using the red toner and so this image object need not be decomposed. However, in this example, no toner applicator 21 can apply black toner to the image roll 22. Accordingly, the controller 27 decomposes the black square into its constituent colors—cyan and red. The controller 27 controls the CEP apparatus 100 to first deposit a cyan patch of toner on the image roll 22 that is slightly larger than the black square, as shown in FIG. 8. Then, the CEP apparatus 100 is controlled to form two patches of red toner, as shown in FIG. 9. The red square patch of toner is deposited over the cyan square, or vice versa, thereby generating a custom color toner layer having red and mixed black portions. The custom color toner layer is then acted on by an electrostatic latent image shown in FIG. 10 as discussed above to form the red circle and black square of FIG. 7. This is merely one example of how the CEP apparatus 100 in accordance with the invention can decompose a color image into constituent color images and generate a final toner image that accurately reproduces the colors in the image. Of course, toner colors other than cyan and red can be used, as discussed above. In addition, black toner can be directly applied by a toner applicator to accurately reproduce black image objects and to avoid combining two or more toners to create a mixed black.

The CEP apparatus 100 shown in FIG. 1 is only one example of a system where toner is applied to the image roll 22 and then acted on by a photoreceptor 23. However, other configurations are possible.

Figure 11:
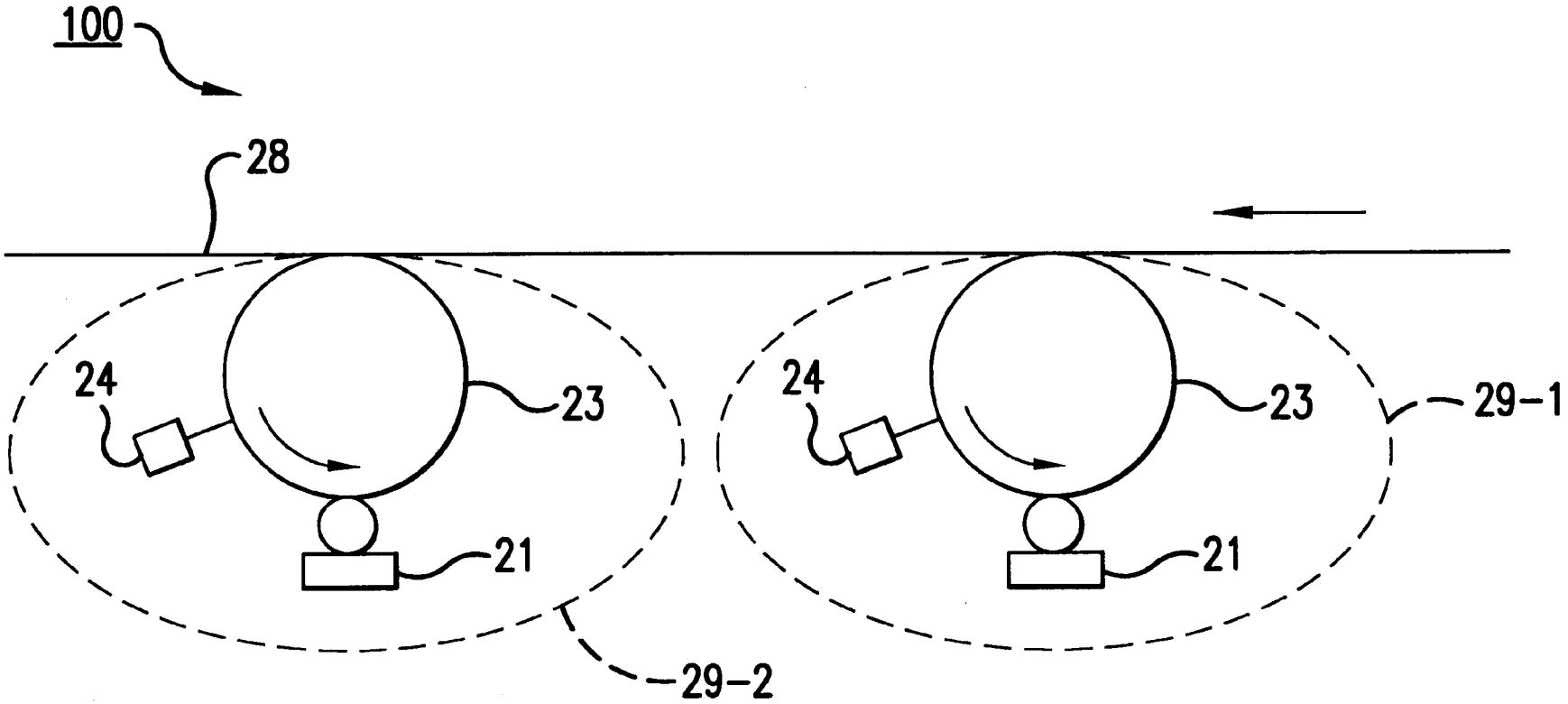
FIG. 11 is a second embodiment of a CEP apparatus in accordance with the invention.

For example, FIG. 11 shows a second embodiment of a printing apparatus in accordance with the invention. In this embodiment, an electrostatic charge pattern is created on a photoreceptor 23 by an electrostatic charge pattern generator 24. Then, toner is applied to the photoreceptor 23 by a toner applicator 21. Preferably, the toner applicator 21 is controllable to selectively apply toner patches to the photoreceptor 23 of varying size, shape, density and location. However, the toner applicators 21 need not be so controllable. Accordingly, a developed toner image is formed on the photoreceptor 23, which is transferred to an image bearing member 28. Together, the toner applicator 21, photoreceptor 23 and electrostatic charge pattern generator 24 form a toner image forming member 29. The first toner image forming member 29-1 forms a first toner image on the image bearing member 28. Then, the second toner image forming member 29-2 forms a second toner image on the image bearing member 28, preferably in registration with the first toner image. For example, the first toner image forming member 29-1 can form a blue toner image on the image bearing member 28. Subsequently, the second toner image forming member 29-2 can form a yellow toner image over or next to the first toner image. Accordingly, the combined first and second toner images can contain toner portions or a toner image having yellow, blue and/or green colors.

In this embodiment, the toner is applied to the photoreceptor 23 after a charge pattern is formed on the photoreceptor 23. However, the toner could be applied directly to the image bearing member 28 rather than the photoreceptor 23. In addition, more than one toner applicator 21 can be used for each toner image forming member 29, and more than one electrostatic charge pattern generator 24 can correspondingly be used for each toner image forming member 29. Optionally, the toner image forming members 29 can be replaced with an entirely different device, such as the CEP apparatus 100 shown in FIG. 1 (optionally excluding the transfixing device 26). In this embodiment, the image bearing member 28 is shown as a substantially flat device, such as a flexible belt. However, the image bearing member 28 can take other forms, such as a rotating drum.

The CEP apparatus 100 shown in FIG. 1 can very accurately develop isolated custom color images or image segments because rough toner patches are first deposited on the image roll 22 and then the toner patches are refined in shape by the electrostatic charge pattern on the photoreceptor 23. However, the ability of the CEP apparatus 100 of FIG. 1 to develop images of different colors next to each other is limited by the ability of the toner applicators 21 to accurately deposit toner patches next to each other. However, the CEP apparatus 100 shown in FIG. 11 can very accurately perform image-next to-image (INI) processes because the accuracy of such processing is dependent mainly upon the ability to properly register the second toner image with respect to the first toner image on the image bearing member 28.

Figure 12:
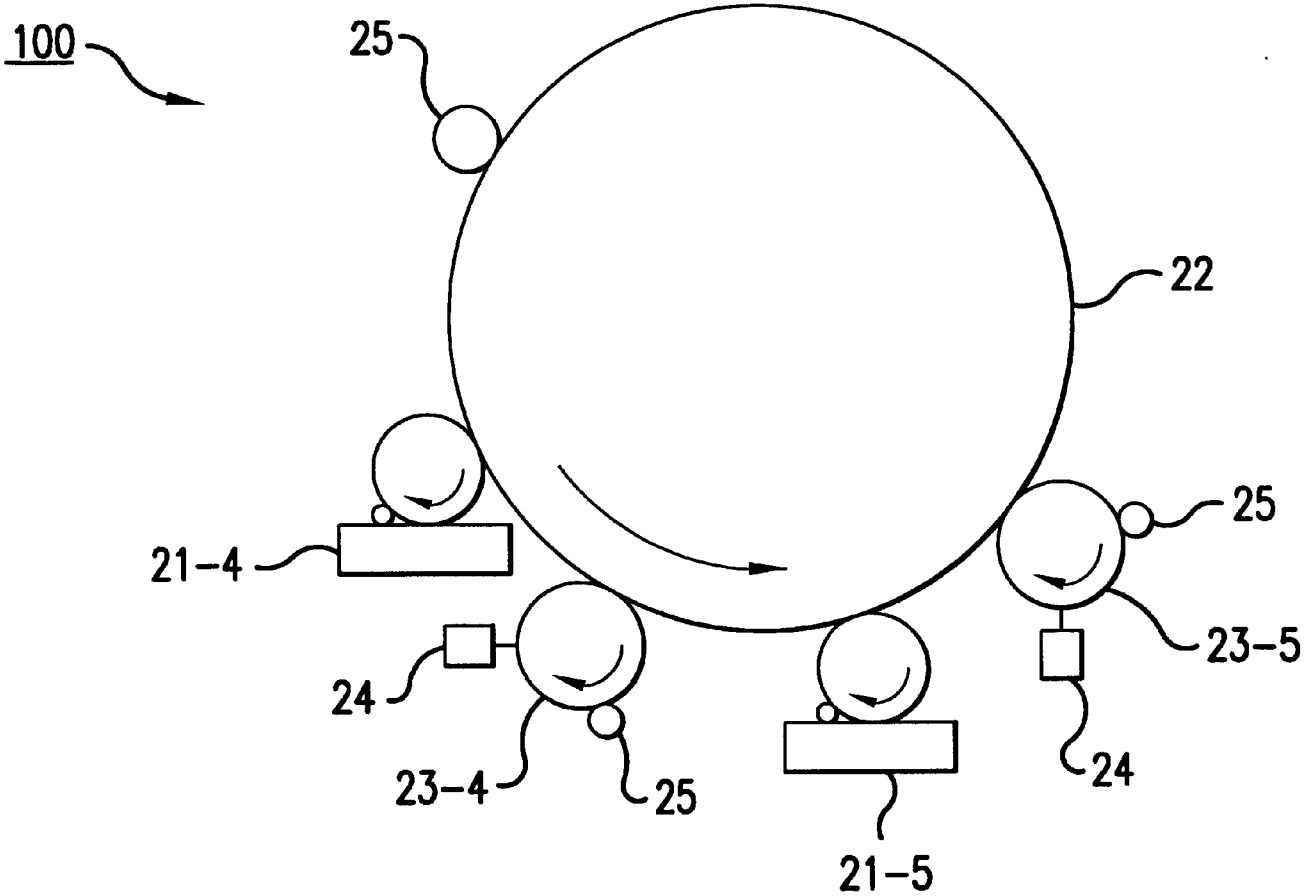
FIG. 12 is a third embodiment of a printing apparatus in accordance with the invention.

FIG. 12 shows a third embodiment of the invention. In this embodiment, toner is applied to an image roll 22 by a first toner applicator 21-4. As in the other embodiments, the toner applicator 21-4 is preferably controllable to deposit toner patches of varying size, shape, density and location on the image roll 22. The toner patches are then acted upon by an electrostatic charge pattern on a first photoreceptor 23-4. Subsequently, a second group of toner patches are applied by a second toner applicator 21-5. The toner patches are then operated on by a second photoreceptor 23-5 to create a final developed toner image on the image roll 22. The final toner image is preferably transferred to another surface, such as a paper substrate or intermediate image support roll (not shown). A cleaning device 25 preferably removes any residual toner and/or charge from the image roll 22. As will be understood by those of ordinary skill in the art, additional pairs of toner applicators 21 and photoreceptors 23 other than the two pairs shown in the FIG. 12 CEP apparatus 100 can be used.

Figure 13:
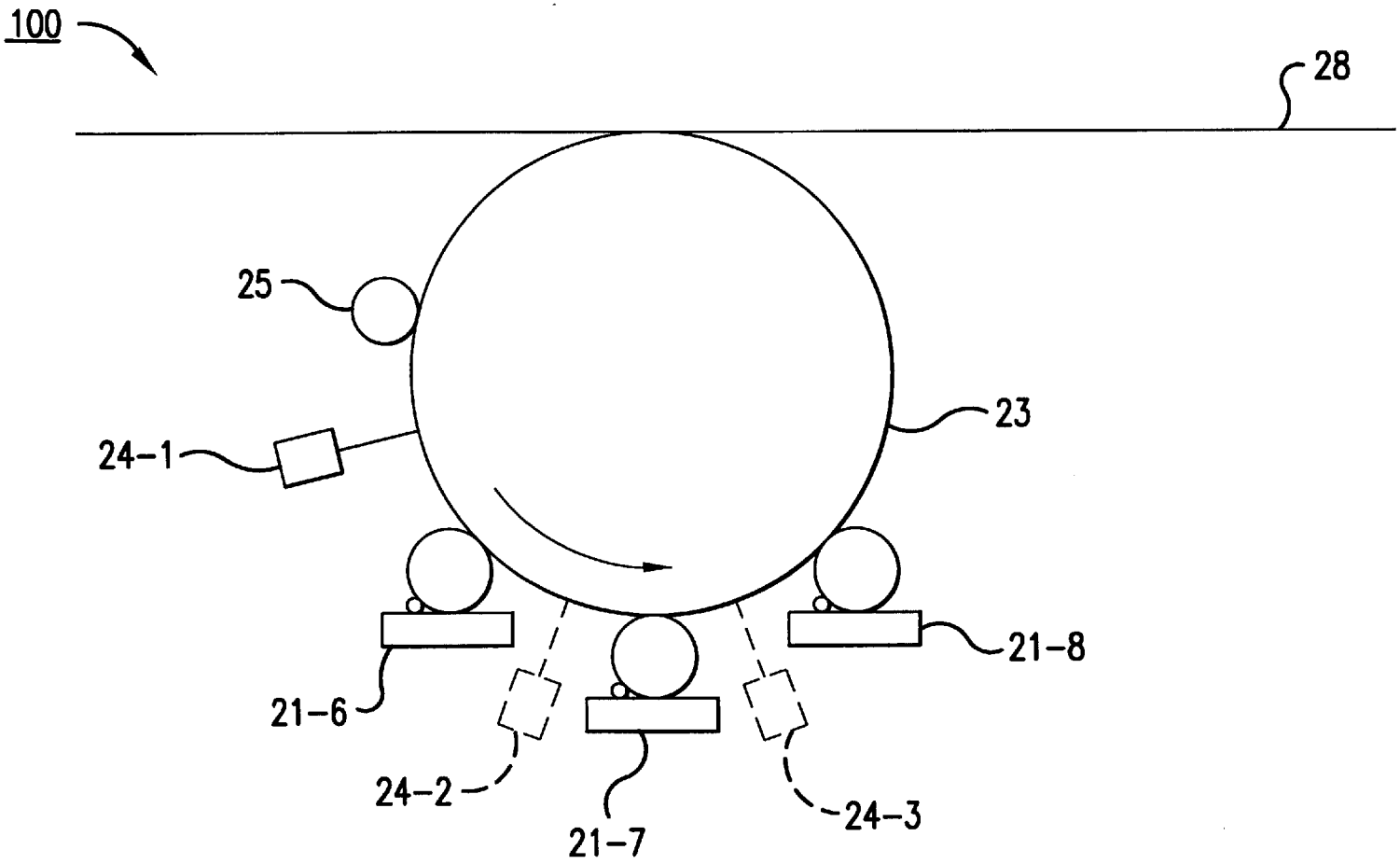
FIG. 13 is a fourth embodiment of a printing apparatus in accordance with the invention.

FIG. 13 shows a fourth embodiment of a printing apparatus 100 in accordance with the invention. In this embodiment, an electrostatic charge pattern is formed on the photoreceptor 23 by a first electrostatic charge pattern generator 24-1. Then, toner patches are applied to the photoreceptor 23 by three toner applicators 21-6, 21-7 and 21-8. The developed toner image is then transferred to an image bearing member 28 or other surface as desired. Optionally, the photoreceptor 23 is recharged and additional electrostatic charge patterns are formed and/or the electrostatic charge pattern is enhanced by second and third electrostatic charge pattern generators 24-2 and 24-3 after each subsequent toner layer is applied to the photoreceptor 23. However, preferably a single electrostatic charge pattern is formed on the photoreceptor 23 and developed multiple times by the toner applicators 21-6, 21-7, and 21-8. After the first development, the contrast on the photoreceptor 23 is reduced, but the residual contrast is sufficient to develop the electrostatic charge pattern at the next toner applicator 21 without recharge or charge pattern enhancement. In addition, a voltage bias between the photoreceptor 23 and each toner applicator 21 can be adjusted to aid in subsequent developments of the electrostatic charge pattern. As in the other embodiments described above, a supply limited development process is preferably used by the toner applicators 21-6, 21-7 and 21-8. That is, a toner layer, or cake, is formed by the toner applicators 21 and the entire thickness, or a predefined portion, or slice, of the entire thickness, is transferred to the photoreceptor 23 in accordance with the electrostatic charge pattern. For example, if charged area development is used, the toner layer is transferred to the photoreceptor 23 at charged areas of the electrostatic charge pattern. The supply limited development process described here is intended to include processes or systems in which a concentrated layer of toner having a layer of dilute fluid formed on one surface is used to develop an electrostatic latent image.

As in the above examples, the apparatus 100 shown in FIG. 13 can use toners of any desired color and include less than or more than three toner applicators 21. As with all of the above embodiments, this embodiment preferably includes a controller 27 for controlling the operation of the apparatus 100.

While the invention has been described with the specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An image forming apparatus using a contact electrostatic printing process, comprising:

at least two toner applicators that deposit toner having a high solid concentration of 10 to 50% on a support;

an image support, at least two toner layers overlapping on the image support; and a charge pattern generator that generates an electrostatic charge pattern that is used to operate on at least one toner layer.

2. The apparatus of claim 1, wherein the toner applicators are controllable to selectively deposit the toner layers in at least one of varying sizes, shapes, densities and locations on a support.

3. The apparatus of claim 1, further comprising a photoreceptor, wherein toner layers are applied to the image support and operated on by an electrostatic charge pattern on the photoreceptor.

4. The apparatus of claim 1, wherein at least one electrostatic charge pattern is generated on the image support before at least one toner layer is applied to the image support.

5. The apparatus of claim 1, wherein a single electrostatic charge pattern is generated on the image support and the electrostatic charge pattern is developed at least twice on the image support.

6. The apparatus of claim 1, comprising at least two toner image forming members, each toner image forming member comprising:

at least one photoreceptor, at least one toner applicator that applies toner to the photoreceptor, and at least one electrostatic charge pattern generator that generates a charge pattern on the photoreceptor before toner is applied to the photoreceptor, wherein each toner image forming member forms a respective toner layer on the image support.

7. The apparatus of claim 1, further comprising a controller that receives image information, decomposes an image represented by the image information into constituent color images, and controls the toner applicators based on the constituent color images.

8. The apparatus of claim 1, further comprising a controller that determines if a toner layer has at least one of a desired color and density and controls a toner applicator to deposit additional toner on the toner layer to correct one of the color and density of the toner layer.

9. A method of performing a contact electrostatic printing process, comprising:

forming a plurality of toner layers on a support, each toner layer initially having a solid concentration of 10–50% and at least two toner layers at least partially overlapping; and forming an electrostatic latent image that acts on at least one of the toner layers.

10. The method of claim 9, wherein the step of forming a plurality of toner layers comprises depositing at least one toner layer in at least one of a desired size, shape, density and location on the support.

11. The method of claim 9, wherein the step of forming the electrostatic latent image comprises:

forming an electrostatic latent image on a photoreceptor; and positioning the electrostatic latent image in sufficient proximity to the support so that the electrostatic latent image selectively acts on toner on the support.

12. The method of claim 9, wherein the step of forming the electrostatic latent image comprises:

forming an electrostatic latent image on the support before at least one toner layer is deposited on the support; and the step of forming the plurality of toner layers comprises: depositing the toner layers on the support to develop the electrostatic latent image.

13. The method of claim 9, wherein the step of forming the plurality of toner layers comprises:

depositing a first toner layer defining a first toner image on the support; and depositing a second toner layer defining a second toner image at least partially overlapping the first toner layer on the support to form a third toner image.

14. A contact electrostatic printing device, comprising:

depositing means for forming a plurality of toner layers on a support, each toner layer initially having a solid concentration of 10–50% and at least two toner layers at least partially overlapping; and forming means for forming an electrostatic latent image that acts on at least one of the toner layers.

15. The contact electrostatic printing device of claim 14, wherein the depositing means comprises addressable applicator means for depositing toner layers of at least one of a desired shape, size, density and location on a support.

16. The contact electrostatic printing device of claim 14, further comprising photoreceptor means for retaining the electrostatic latent image.

17. An addressable toner applicator comprising:

a plurality of addressable electrodes; and a counter electrode;

wherein a voltage bias between each addressable electrode and the counter electrode determines at least one of a size, shape and density of an electrostatically activated toner patch, having a solid concentration of 10–50%, that is deposited on one of the addressable electrode and the counter electrode.

18. The addressable toner applicator of claim 17, wherein the plurality of addressable electrodes together form a substantially flat structure, and the counter electrode is a toner support.

19. The addressable toner applicator of claim 17, wherein the counter electrode is substantially flat, and the plurality of addressable electrodes together form a substantially cylindrical roller that rotates.

20. The addressable toner applicator of claim 17, wherein the plurality of addressable electrodes together form a substantially cylindrical roller that rotates, and the counter electrode is a substantially cylindrical member.

21. An image forming apparatus comprising the addressable toner applicator of claim 17.

22. An image forming apparatus, comprising:

an image support;

at least one addressable toner applicator that applies toner in layers of at least one of variable size, shape, location and density on a support; and a charge pattern generator that generates an electrostatic charge pattern that is used to operate on at least one toner layer formed by the addressable toner applicator on a support to form a toner image.

23. The apparatus of claim 22, further comprising a photoreceptor, wherein toner layers are applied to the image support and operated on by an electrostatic charge pattern on the photoreceptor.

24. The apparatus of claim 22, further comprising a photoreceptor, wherein an electrostatic charge pattern is generated on the photoreceptor before a toner layer is applied to the photoreceptor by the addressable toner applicator.

25. The apparatus of claim 22, wherein the electrostatic charge pattern is formed on the image support and the electrostatic charge pattern is developed at least twice.

* * * * *